US012590430B2

(12) United States Patent
Kueper

(10) Patent No.: US 12,590,430 B2
(45) Date of Patent: Mar. 31, 2026

(54) CLEARING STRIP FOR THE CLEARING BLADE OF A SNOWPLOW

(71) Applicant: Kueper GmbH & Co. KG, Bochum (DE)

(72) Inventor: Roland Kueper, Bochum (DE)

(73) Assignee: Kueper GmbH & Co. KG, Bochum (DE)

( * ) Notice: Subject to any disclaimer, the term of this patent is extended or adjusted under 35 U.S.C. 154(b) by 443 days.

(21) Appl. No.: 18/028,064

(22) PCT Filed: Sep. 21, 2021

(86) PCT No.: PCT/EP2021/075949

§ 371 (c)(1),
(2) Date: Mar. 23, 2023

(87) PCT Pub. No.: WO2022/063780

PCT Pub. Date: Mar. 31, 2022

(65) Prior Publication Data

US 2023/0340740 A1 Oct. 26, 2023

(30) Foreign Application Priority Data

Sep. 25, 2020 (DE) ..... 10 2020 125 134.3

(51) Int. Cl.
*E01H 5/06* (2006.01)

(52) U.S. Cl.
CPC ..... *E01H 5/061* (2013.01)

(58) Field of Classification Search
CPC ..... E01H 5/06; E01H 5/061; E01H 5/062
See application file for complete search history.

(56) References Cited

U.S. PATENT DOCUMENTS 5,746,017 A * 5/1998 Marvik ..... E01H 5/061 37/446
7,765,726 B2 * 8/2010 Kuper ..... E01H 5/061 172/701.3
9,428,874 B2 * 8/2016 Winter ..... E01H 5/061
(Continued)

FOREIGN PATENT DOCUMENTS

DE 8300983 U1 6/1983
DE 10 2016 114 457 A1 2/2018

OTHER PUBLICATIONS

International Search Report in PCT/EP2021/075949 dated Jan. 10, 2022 with English translation.

*Primary Examiner* — Joseph M Rocca
*Assistant Examiner* — Robert E Pezzuto
(74) *Attorney, Agent, or Firm* — Collard & Roe, P.C.

(57) ABSTRACT

There is a clearing strip for the clearing blade of a snowplow, comprising a front steel plate and a rear steel plate, which can be jointly fastened to the bottom edge of the clearing blade by means of fastening screws and between which an elastic rubber body is disposed. A metal wear strip is vulcanized into the rubber body, wherein the strip protrudes out of the rubber body downward toward the surface to be cleared and has a clearing edge which contacts the surface to be cleared. The strip is secured against release from the clearing strip with minimal design complexity, and without loss of the elastic play of the wear strip required for normal operation.

4 Claims, 6 Drawing Sheets

(56) References Cited

U.S. PATENT DOCUMENTS

| | | | | |
|---|---|---|---|---|
| 2009/0223090 | A1* | 9/2009 | Hunt | E01H 5/061 37/266 |
| 2015/0376850 | A1 | 12/2015 | Giletta | |
| 2022/0341110 | A1 | 10/2022 | Kueper | |

* cited by examiner

CLEARING STRIP FOR THE CLEARING BLADE OF A SNOWPLOW

CROSS REFERENCE TO RELATED APPLICATIONS

This application is the National Stage of PCT/EP2021/075949 filed on Sep. 21, 2021, which claims priority under 35 U.S.C. § 119 of German Application No. 10 2020 125 134.3, filed on Sep. 25, 2020, the disclosure of which is incorporated by reference. The international application under PCT article 21(2) was not published in English.

BACKGROUND/SUMMARY

The invention relates to a clearing strip for the clearing blade of a snowplow, having a front steel plate and a rear steel plate, which can be jointly fastened to the bottom edge of the clearing blade by means of fastening screws, and between which an elastic rubber body is arranged, wherein at least one metal wear strip is vulcanized into the rubber body, which strip projects downward out of the rubber body, toward the surface to be cleared, and has a clearing edge that touches the surface to be cleared.

Such a clearing strip is known, for example, from the document DE 3 334 121 A1. The clearing strip disclosed there is attached to the clearing blade by means of oblong holes arranged in the center at the top of the steel plates, and fastening screws. For this purpose, the two steel plates make almost direct contact with one another in the region of the screw connection. The rear steel plate runs downward and is cropped. The rubber body is arranged between the two steel plates, in the cropped region. By means of a metal wear strip vulcanized into the rubber body, projecting downward, which strip consists, as a rule, of a highly wear-resistant steel, the clearing strip as a whole is relatively aggressive, similar to a one-piece steel clearing strip. The metal wear strip vulcanized into the rubber body is, however, mounted in the rubber body with elastic resilience, and can escape both upward and to the back if there are irregularities in the surface to be cleared, for example in the form of road markings, bridge joints or manhole covers.

During the clearing process, and in particular during complete clearing down to the surface, heat often occurs due to friction, so that the metal wear strip heats up. Due to this heat development, the vulcanized connection between wear strip and rubber body can be damaged to such an extent that the wear strip falls out of the rubber body. As a result, significant hazards can occur in the surroundings, in particular for vehicles that follow the plow in traffic.

In order to counteract this hazard, DE 3 334 121 A1 proposes providing bores through the steel plates, the rubber body, and the wear strip, into which bores suitable pins are inserted. The pins are supposed to fix the wear strip in place on the steel plates, in case the connection between the wear strip and the rubber body is lost due to the development of heat.

However, this measure has multiple disadvantages. The bores must be made in an additional work step during production. The pins represent additional components and must be inserted in an additional work step. In particular, these pins significantly restrict the mobility of the wear strip due to the rigid connection between the steel plates and the wear strip, so that the clearing strip as a whole loses the advantages described above, which are supposed to result from the resilient embedding of the wear strip in the rubber body. Furthermore, the danger exists that the pins will already break during normal operation of the clearing strip, because already during normal operation they must absorb the forces that occur during every movement of the wear strip relative to the steel plates. If the pins already break during normal operation due to impacts that occur, their holding function is no longer guaranteed, so that in the event of overheating of the rubber body, the traffic following the plow is endangered if the wear strips fall out, as has been explained above.

SUMMARY

It is therefore the task of the invention to further develop the clearing strip of the type indicated initially, in such a manner that the metal wear strip, which is necessary for aggressive clearing, is secured to prevent it from coming loose from the clearing strip, using the least possible design effort, without the elastic movement play that is required for normal operation being lost.

To accomplish this task, the invention proposes, proceeding from a clearing strip of the type stated initially, that corresponding fastening openings are arranged in the steel plates and the rubber body, aligned with one another, through which openings fastening screws for fastening the clearing strip to the clearing blade pass, and that the wear strip is provided with securing recesses through which the fastening screws are passed, and the inner circumferences of which recesses leave spaces from the outer circumferences of the fastening screws, which spaces correspond to the maximum permissible elastic movement play of the wear strip vulcanized into the rubber body.

The securing recesses in the metal wear strip are already provided during the production of the wear strip, so that later machining of the wear strip is no longer necessary. The fastening screws used for fastening the clearing strip to the clearing blade simultaneously serve, according to the teaching of the invention, for securing the metal wear strip in the rubber body, so that separate pins for securing the wear list are no longer required. The metal wear strip, secured using the securing recesses and the fastening screws, can no longer fall out of the clearing strip, even in the event of great heat development. As a result of the great distances between the inner circumferences of the securing recesses in the wear strip and the outer circumferences of the fastening screws, the wear strip remains elastically movable in the rubber body and can flexibly escape from obstacles upward and to the rear, without the fastening screws being damaged.

An advantageous further development of the invention provides that hard material wear bodies, preferably composed of tungsten carbide, are integrated into the metal wear strip at the clearing edge. By means of these integrated hard material wear bodies, the steel strip wears more slowly. In addition, the sliding behavior of the clearing strip is improved, so that the heat development is also less.

A modified embodiment of the invention provides that in addition, spacer sleeves that surround the fastening screws are arranged in the rubber body, the end faces of which sleeves are supported on the steel plates, and the outer circumferences of which sleeves leave spaces from the inner circumferences of the related safety recesses in the wear strip, which spaces correspond to the maximum permissible elastic movement play of the wear strip vulcanized into the rubber body. These support sleeves are firmly braced between the two steel plates during tightening of the fastening screws, and thereby form a rigid connection between the two steel plates. In order for the metal wear strip to be secured against falling out here, too, and nevertheless to maintain its elastic mobility relative to the spacer sleeves that are braced in place, here too spaces are provided between the outer circumferences of the spacer sleeves, on the one hand, and the inner circumferences of the securing recesses, on the other hand, which spaces correspond to the maximum permissible elastic movement play of the metal wear strip that is vulcanized into the rubber body.

Furthermore, it is advantageous if at least two or more metal wear strips are vulcanized into the rubber body, distributed over the length of the clearing strip. The forces that act on the individual wear strips during the clearing process are less and in the case of using a single, correspondingly longer wear strip. Furthermore, multiple short wear strips are more flexible than one long wear strip.

Two exemplary embodiments of the invention will be explained in greater detail in the following, using the drawings. These show:

DETAILED DESCRIPTION

Figure 1A:
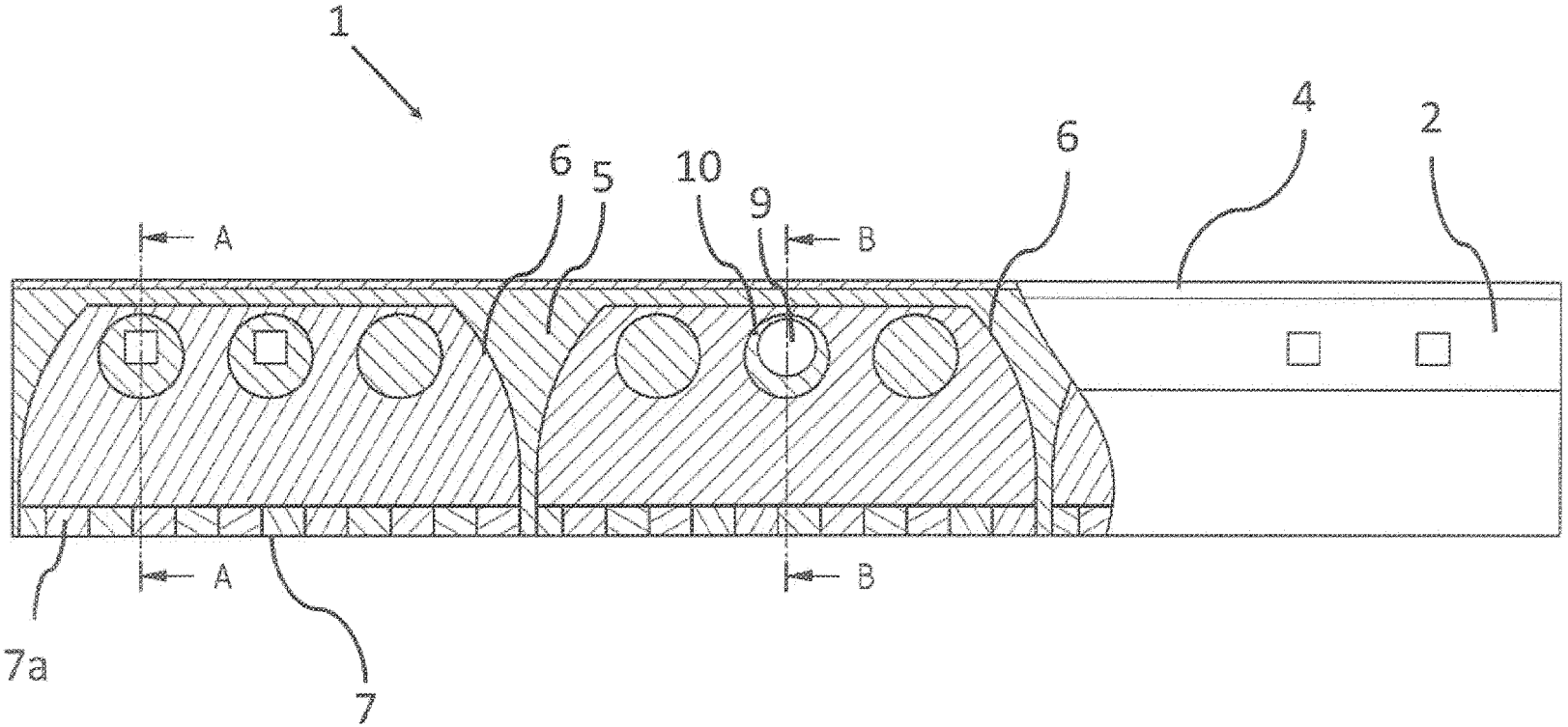
FIG. 1*a*: schematically, a clearing strip according to the invention, in a first embodiment, in a front view, partly in section.
Figure 1C:
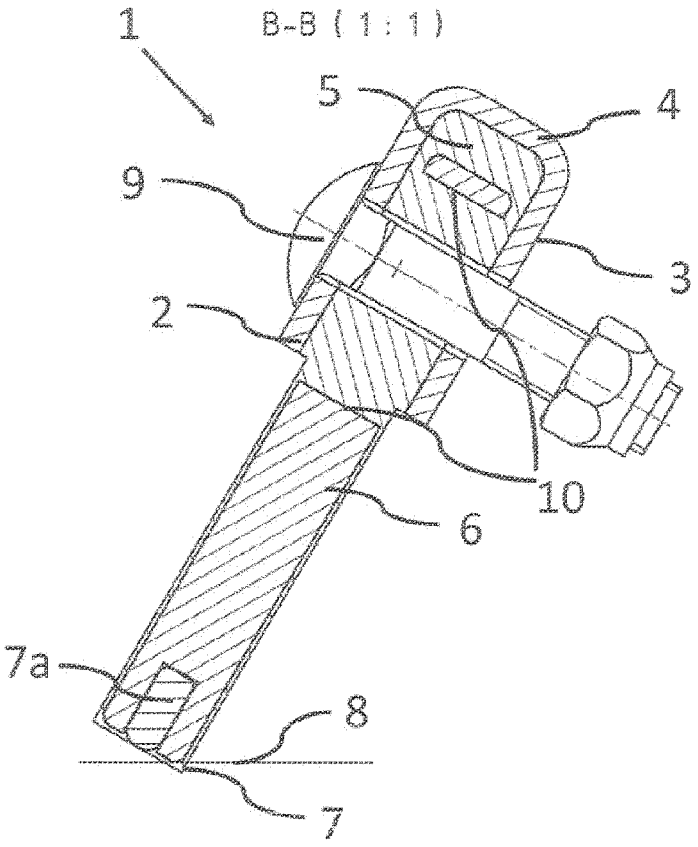
FIG. 1*c*: schematically, a section through the clearing strip according to FIG. 1*a*, along the section line B-B (with fastening screw)
Figure 1B:
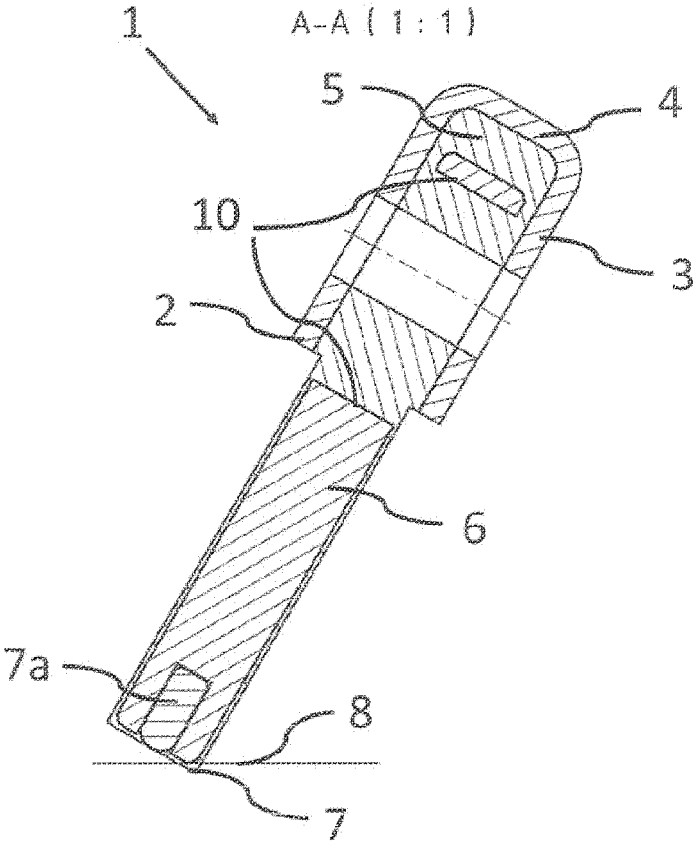
FIG. 1*b*: schematically, a section through the clearing strip according to FIG. 1*a*, along the section line A-A (without fastening screw)

In FIGS. 1*a* and 1*b*, a clearing strip is referred to, in its totality, with the reference symbol 1. The clearing strip 1 has a front steel plate 2 and a rear steel plate 3, which are connected in one piece with one another, on their top side, by means of an arched piece 4 that also consists of steel.

An elastic rubber body 5 is arranged between the two steel plates 2, 3. Three metal wear strips 6 are vulcanized into this rubber body 5. These wear strips 6, which consist of high-strength steel, project downward out of the rubber body 5 and have a clearing edge 7 at their end that projects out of the rubber body 5, which edge touches the surface 8 to be cleared—which is generally the road surface—during operation of the snowplow. Hard material wear bodies 7*a* composed of tungsten carbide are integrated into the clearing edges 7 of the wear strips 6, in order to reduce wear and to improve the sliding properties.

To fasten the clearing strip 1 onto the clearing blade of a snowplow, not shown in the drawing, fastening screws 9 are provided, which are passed through fastening openings in the steel plates 2 and 3, the rubber body 5, and the wear strips 6, which openings are arranged to align with one another and correspond to one another. In this regard, according to the teaching of the invention, the passage openings for the fastening screws that are situated in the wear strips 6 are widened to form securing recesses 10, specifically in such a manner that spaces occur between the outer circumferences of the fastening screws 9 and the inner circumferences of the securing recesses 10, which spaces correspond to the maximum permissible elastic movement play of the wear strips 6 vulcanized into the rubber body 5. The amount of this movement play that must be provided in an individual case depends on the volume and the elastic properties of the rubber body 5 as well as on the size and direction of the forces that occur during operation and act on the wear strips 6.

Figure 2A:
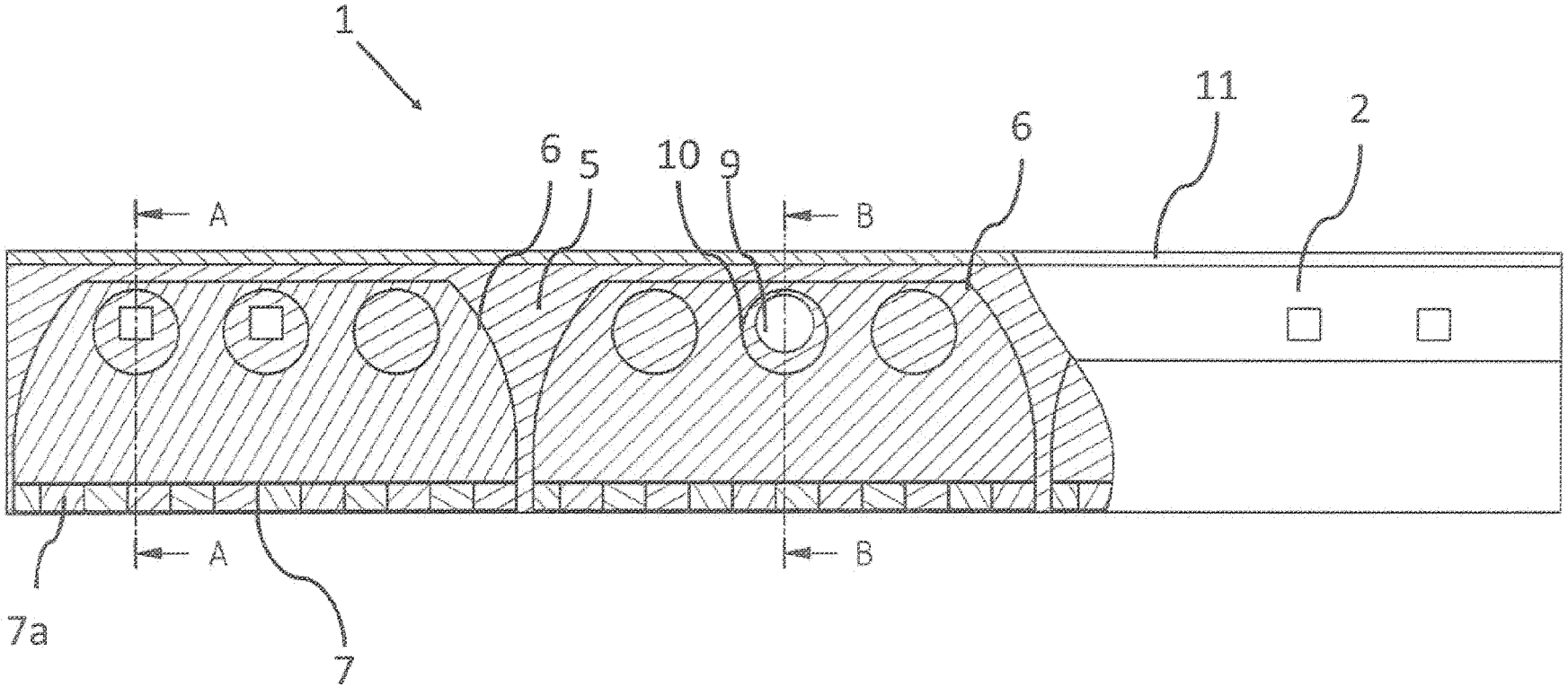
FIG. 2*a*: schematically, a clearing strip according to the invention, in a second embodiment, in a front view, partly in section.
Figure 2C:
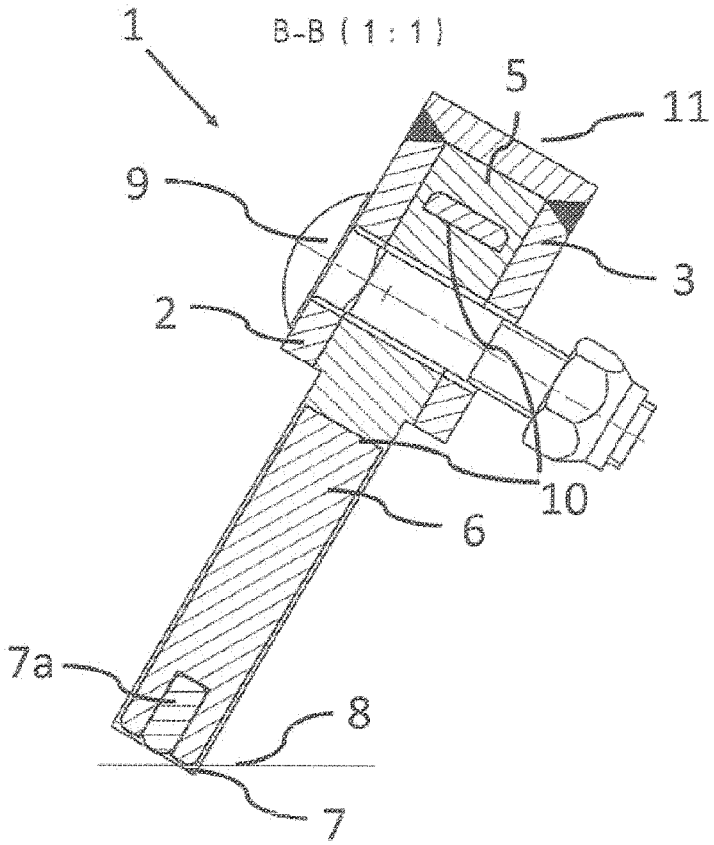
FIG. 2*c*: schematically, a section through the clearing strip according to FIG. 2*a*, along the section line B-B (with fastening screw)
Figure 2B:
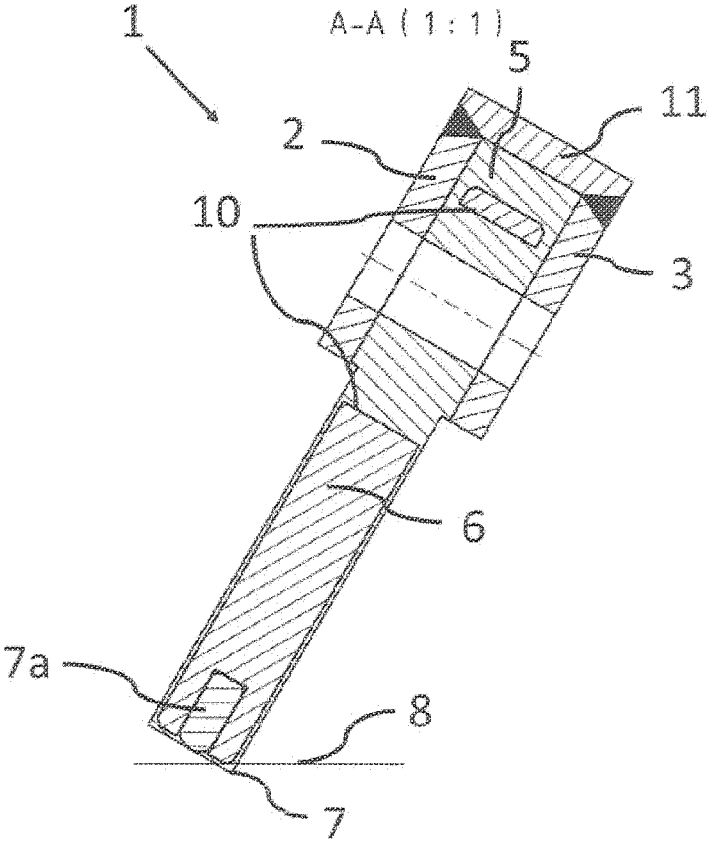
FIG. 2*b*: schematically, a section through the clearing strip according to FIG. 2*a*, along the section line A-A (without fastening screw)

The exemplary embodiment of FIGS. 2*a*, 2*b* and 2*c* essentially corresponds to the exemplary embodiment according to FIGS. 1*a*, 1*b* and 1*c*, with the difference that here the two steel plates 2 and 3 are not connected with one another in one piece, but rather are connected with one another by means of a connection piece 11 that is welded on. In the case of both the exemplary embodiments that have been explained until now, the space between the outer circumferences of the fastening screws 9 and the inner circumferences of the securing recesses 10 can alternatively be filled with rubber compound or also remain free of rubber compound.

Figure 3A:
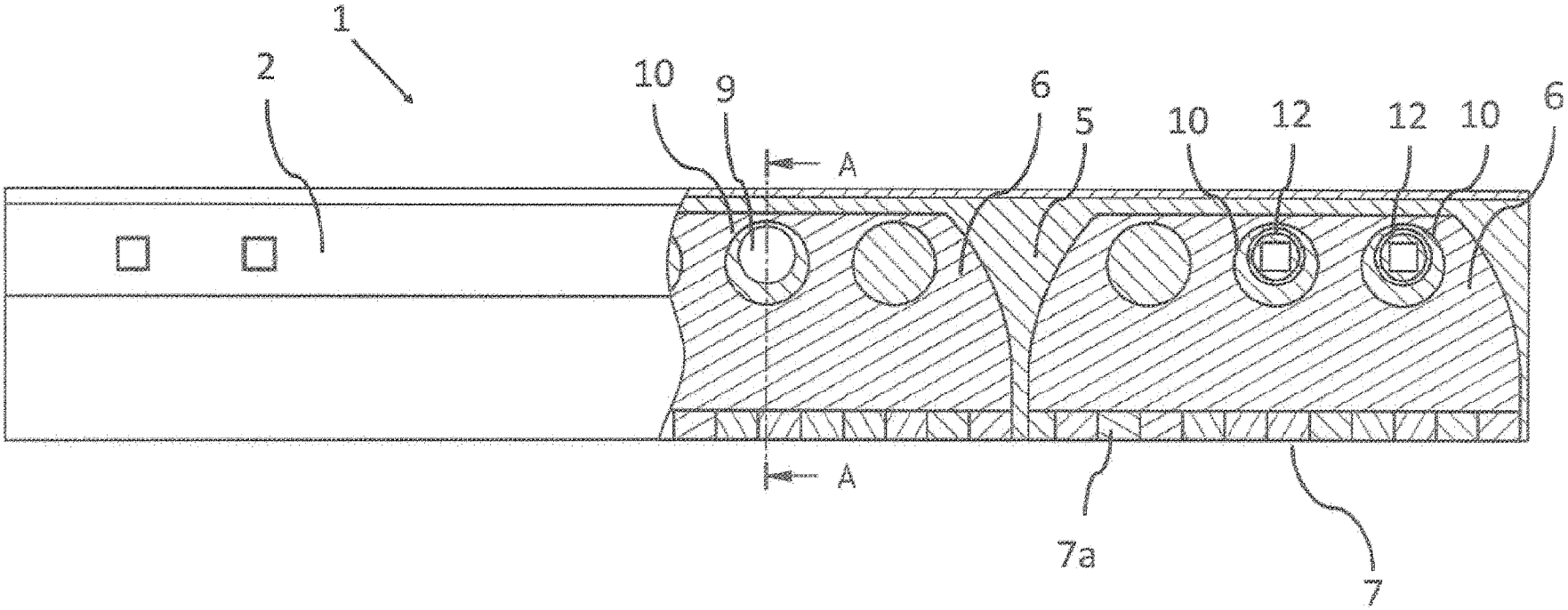
FIG. 3*a*: schematically, a clearing strip according to the invention, in a third embodiment, in a front view, partly in section.
Figure 3B:
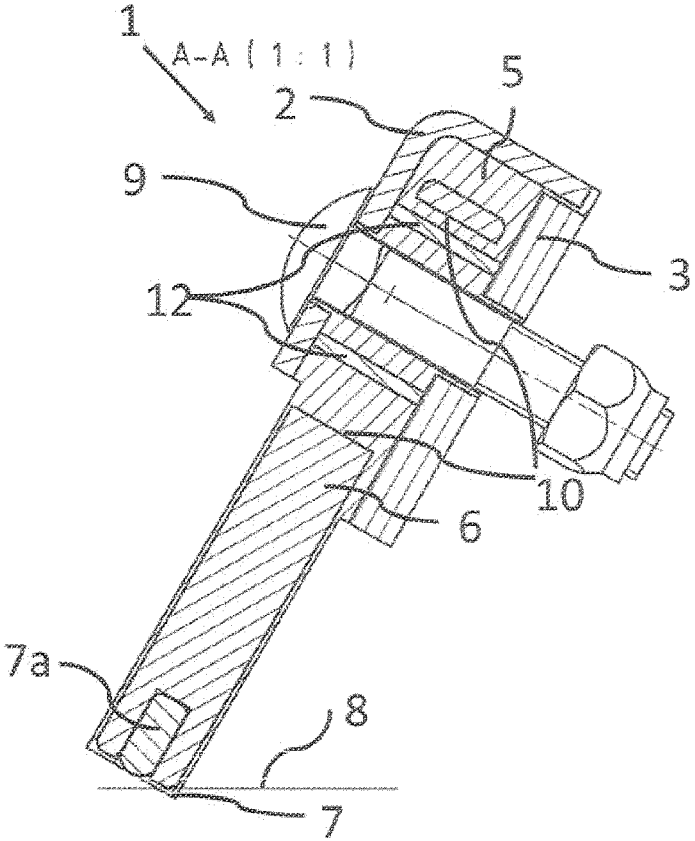
FIG. 3*b*: schematically, a section through the clearing strip according to FIG. 3*a*, along the section line A-A (with fastening screw)

The exemplary embodiments of FIGS. 3*a* and 3*b* differs from the exemplary embodiments shown above, first of all in that here, the two steel plates 2 and 3 are not connected with one another, but rather are essentially held together by the fastening screws 9. In order to nevertheless ensure the correctly dimensioned space between the two steel plates 2 and 3, in this exemplary embodiment spacer sleeves 12 that surround the fastening screws 9 are additionally provided in the rubber body 5, the end faces of which sleeves are supported on the steel plates 2 and 3, and the outer circumferences of which sleeves leave spaces from the inner circumferences of the related safety recess in 10 in the wear strips 6, which spaces correspond to the maximum permissible elastic movement play of the wear strips 6 vulcanized into the rubber body 5.

Here, too, the spaces between the outer circumferences of the spacer sleeves 12 and the inner circumferences of the securing recesses 10 can be filled with rubber compound or also remain free of rubber compound.

REFERENCE SYMBOL LIST

1 clearing strip
2 steel plate
3 steel plate
4 arched piece
5 rubber body
6 wear strip
7 clearing edge
7*a* hard material wear bodies
8 surface to be cleared
9 fastening screw
10 securing recess
11 connection piece
12 spacer sleeve

The invention claimed is:

1. A clearing strip for the clearing blade of a snowplow, comprising:

an elastic rubber body (5);

at least one metal wear strip (6)

a plurality of steel plates comprising a front steel plate (2) and a rear steel plate (3), which can be jointly fastened to a bottom edge of the clearing blade by means of a plurality of fastening screws (9), and between which said elastic rubber body(5) is arranged, wherein said at least one metal wear strip (6) is vulcanized into the elastic rubber body (5), wherein said at least one metal wear strip (6) projects downward out of the elastic rubber body (5), toward a surface to be cleared, and has a clearing edge that touches the surface to be cleared, wherein corresponding fastening openings are arranged in said front steel plate(2), said rear steel plate (3) and the elastic rubber body (5), aligned with one another, through which said corresponding fastening openings said plurality of fastening screws (9) for fastening the clearing strip to the clearing blade pass, and wherein the elastic metal wear strip (6) is provided with a plurality of securing recesses (10) through which the plurality of fastening screws (9) are passed, and the inner circumferences of said plurality of securing recesses (10) leave spaces from the outer circumferences of the plurality of fastening screws (9), wherein said spaces correspond to a maximum permissible elastic movement play of the at least one metal wear strip (6) vulcanized into said elastic rubber body (5).

2. The clearing strip according to claim 1, wherein said at least one metal wear strip further comprises hard material wear bodies, composed of tungsten carbide, which are integrated into the at least one metal wear strip at the clearing edge.

3. The clearing strip according to claim 1, further comprising spacer sleeves (12) that surround the plurality of fastening screws (9) and which are arranged in the elastic rubber body (5), wherein said spacer sleeves have end faces which are supported on the plurality of steel plates, and wherein said spacer sleeves have outer circumferences of which leave spaces from the inner circumferences of the related plurality of-securing recesses in the at least one metal wear strip, which spaces correspond to the maximum permissible elastic movement play of the at least one metal wear strip vulcanized into the elastic rubber body.

4. The clearing strip according to claim 1, wherein said at least one metal wear strip comprises at least two or more metal wear strips which are provided in said at least one elastic rubber body, distributed over the length of the clearing strip.

* * * * *